US010215542B2

(12) United States Patent
Schaller et al.

(10) Patent No.: US 10,215,542 B2
(45) Date of Patent: Feb. 26, 2019

(54) SYSTEM FOR ANALYZING PERFORMANCE OF AN ACTIVITY INVOLVING USING AN IMPLEMENT TO STRIKE A MOVING TARGET OBJECT EFFECTIVELY

(71) Applicant: Virtual Clays, LLC, Irvine, CA (US)

(72) Inventors: Sarah J. Schaller, Irvine, CA (US); Gordon A. Schaller, Irvine, CA (US)

(73) Assignee: VIRTUAL CLAYS, LLC, Irvine, CA (US)

( * ) Notice: Subject to any disclaimer, the term of this patent is extended or adjusted under 35 U.S.C. 154(b) by 416 days.

(21) Appl. No.: 14/963,677

(22) Filed: Dec. 9, 2015

(65) Prior Publication Data

US 2017/0169721 A1 Jun. 15, 2017

(51) Int. Cl.

| | |
|---|---|
| ***F41J 9/18*** | (2006.01) |
| ***F41J 9/16*** | (2006.01) |
| *F41A 17/06* | (2006.01) |

(52) U.S. Cl.

CPC ..... *F41J 9/18* (2013.01); *F41J 9/165* (2013.01); *F41A 17/063* (2013.01)

(58) Field of Classification Search

CPC ..... F41J 9/18; F41J 9/165; F41J 5/14; F41A 17/063

See application file for complete search history.

(56) References Cited

U.S. PATENT DOCUMENTS 6,159,112 A * 12/2000 Ciluffo ..... A63B 69/0024 124/4
6,474,159 B1 11/2002 Foxlin et al.
8,523,696 B2 9/2013 Kamino et al.
8,725,452 B2 5/2014 Han
8,781,610 B2 7/2014 Han
8,989,441 B2 3/2015 Han et al.
2011/0311949 A1* 12/2011 Preston ..... F41G 3/26 434/16
2015/0308789 A1* 10/2015 Righi ..... F41G 3/26 434/19

OTHER PUBLICATIONS

MANTISX, "MANTISX Firearms Training System," http://mantisx.com/, (c) 2015, Accessed Jan. 24, 2016.
Beretta, "Gun Pod Instructions," http://www.a400xplor.com/gun-pod-a400-xplor/index.aspx?m=&did=1401, Accessed Sep. 24, 2015.
Arccos, "The #1 Performance Tracker in Golf," http://www.arccosgolf.com/, Accessed Sep. 24, 2015.

* cited by examiner

*Primary Examiner* — Timothy A Musselman
(74) *Attorney, Agent, or Firm* — Bennet K. Langlotz; Langlotz Patent & Trademark Works, Inc.

(57) ABSTRACT

Systems for analyzing performance of an activity involving using an implement to strike a moving target object effectively have a first sensor attached to the implement, a second sensor attached to a launcher human or mechanically operable to launch the moving target, wherein the first sensor generates a signal associated with motion of the implement, wherein a second sensor generates a signal associated with motion of at least one of the group consisting of the launcher and the moving target being launched, a processor operably coupled to the first and second sensors to receive the signals generated by the first and second sensors, and wherein the processor analyzes the received signals to measure performance of the activity. The implement may be a firearm. The implement may be a shotgun. The launcher may be a clay pigeon trap.

17 Claims, 2 Drawing Sheets

SYSTEM FOR ANALYZING PERFORMANCE OF AN ACTIVITY INVOLVING USING AN IMPLEMENT TO STRIKE A MOVING TARGET OBJECT EFFECTIVELY

FIELD OF THE INVENTION

The present invention relates to firearms, and more particularly to a system for analyzing performance of clay pigeon shooting involving using discharged shot from a shotgun to strike a moving target clay pigeon effectively.

BACKGROUND OF THE INVENTION

Clay pigeon shooting is a sport involving shooting a shotgun at special flying targets, known as clay pigeons or clay targets. A machine called a trap throws the clay pigeons into the air as singles or doubles or on the ground as a "rabbit." The targets can be thrown at a great variety of trajectories, angles, speeds, elevations, and distances. The targets are typically in the shape of an inverted saucer. They are designed to withstand being thrown by a trap at high speeds, but are also intended to be easily broken when hit by just a few shot pellets discharged by a shotgun. The targets are made to precise specifications regarding their weight and dimensions, and several different target types are established by international standards.

While various sensor-based systems for various sports have been developed, they typically include a sensor attached only to the implement that will strike a moving object. None track the moving object separately or in relation to the striking implement. Also, none involve sensors attached to the moving object to be struck as this would greatly increase the cost of the system. First, a sport using multiple targets would require each target to have its own sensor installed. Second, a sensor on a clay pigeon would likely be destroyed by the collision with the shot pellets that is the sport's objective, so the sensor would not be reusable. Finally, creating an object to be tracked having an attached sensor that has the same performance characteristics as the standard version of the object may require considerable research and development effort. None of the existing sport-based sensor systems provide the quality of data that would be derived from tracking the moving object and implement separately and in relation to each other.

As is shown in FIG. 1, it is well-known that the shooter 100 with a conventional shotgun 102 has to visually establish an initial point of aim 104 at the flying clay pigeon target 112 at a pickup point 114 after the target is thrown, determine the expected flight path 116 of the target, and establish a final point of aim 106 before pulling the trigger that leads the target by a sufficient distance 110 that the discharged shot pellets 108 do not miss behind the target. The final point of aim must also ensure the discharged shot pellets do not miss above, below, or in front of the target. Although significant amounts of motion analysis have been performed for the striking implement used in some sports, such as golf clubs, baseball bats, and tennis rackets, a dearth of quantitative data exists that establishes the difference between an expert and a non-expert for clay pigeon shooting, or that allows the shooter to ascertain how changes in his/her shooting motion affect the qualitative results. As a result, it would be highly useful to obtain data that define the characteristics of expert clay pigeon shooting with a shotgun and then using that data to coach non-experts to improve their performance.

Therefore, a need exists for a new and improved system for analyzing performance of an activity involving using an implement to strike directly or indirectly a moving target object effectively that determines the characteristics of expert usage of a shotgun for shooting clay pigeons without attaching a sensor to the object being tracked. In this regard, the various embodiments of the present invention substantially fulfill at least some of these needs. In this respect, the system for analyzing performance of an activity involving using an implement to strike directly or indirectly a moving target object effectively according to the present invention substantially departs from the conventional concepts and designs of the prior art, and in doing so provides an apparatus primarily developed for the purpose of enabling determination of the characteristics of expert usage of a shotgun for shooting clay pigeons without attaching a sensor to the object being tracked.

SUMMARY OF THE INVENTION

The present invention provides an improved system for analyzing performance of clay pigeon shooting involving using discharged shot from a shotgun to strike a moving target clay pigeon effectively, and overcomes the above-mentioned disadvantages and drawbacks of the prior art. As such, the general purpose of the present invention, which will be described subsequently in greater detail, is to provide an improved system for analyzing performance of an activity involving using an implement to strike a moving target object effectively that has all the advantages of the prior art mentioned above.

To attain this, the preferred embodiment of the present invention essentially comprises a first sensor attached to the implement, a second sensor attached to a launcher human or mechanically operable to launch the moving target, wherein the first sensor generates a signal associated with motion of the implement, wherein a second sensor generates a signal associated with motion of at least one of the group consisting of the launcher and the moving target being launched, a processor operably coupled to the first and second sensors to receive the signals generated by the first and second sensors, and wherein the processor analyzes the received signals to measure performance of the activity. The implement may be a firearm. The implement may be a shotgun. The launcher may be a clay pigeon trap. The first sensor may be attached to a location selected from the group consisting of a butt of a grip of the firearm, a forestock of the firearm, a side of a firearm stock opposite a shooter's face, and a barrel of the firearm. The activity may be clay pigeon shooting. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
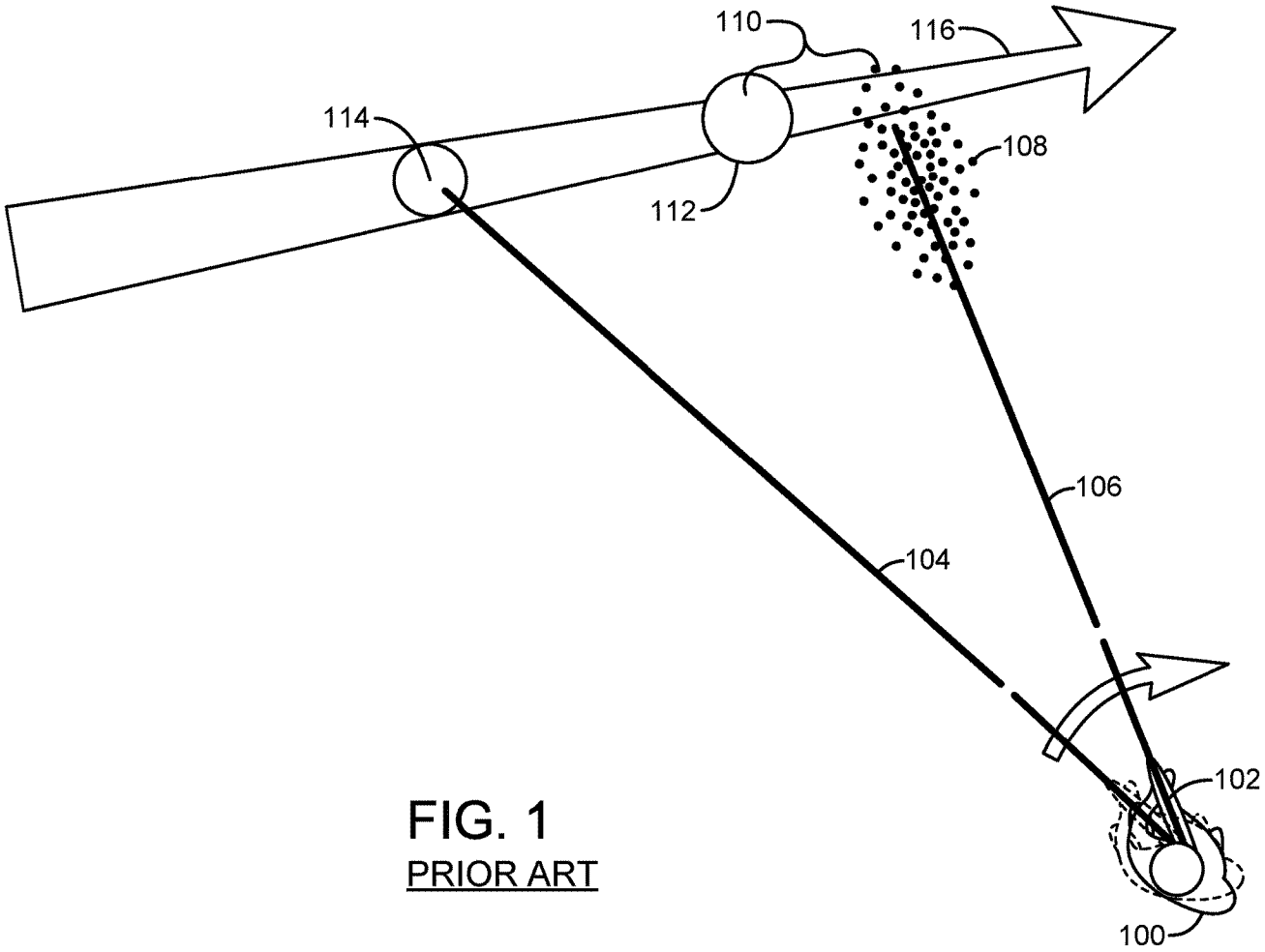
FIG. 1 PRIOR ART
FIG. 1 is a schematic view of the prior art method for hitting a flying clay pigeon with shot pellets discharged from a shotgun.

An embodiment of the system for analyzing performance of an activity involving using an implement to strike a moving target object effectively of the present invention is shown and generally designated by the reference numeral 10.

Figure 2:
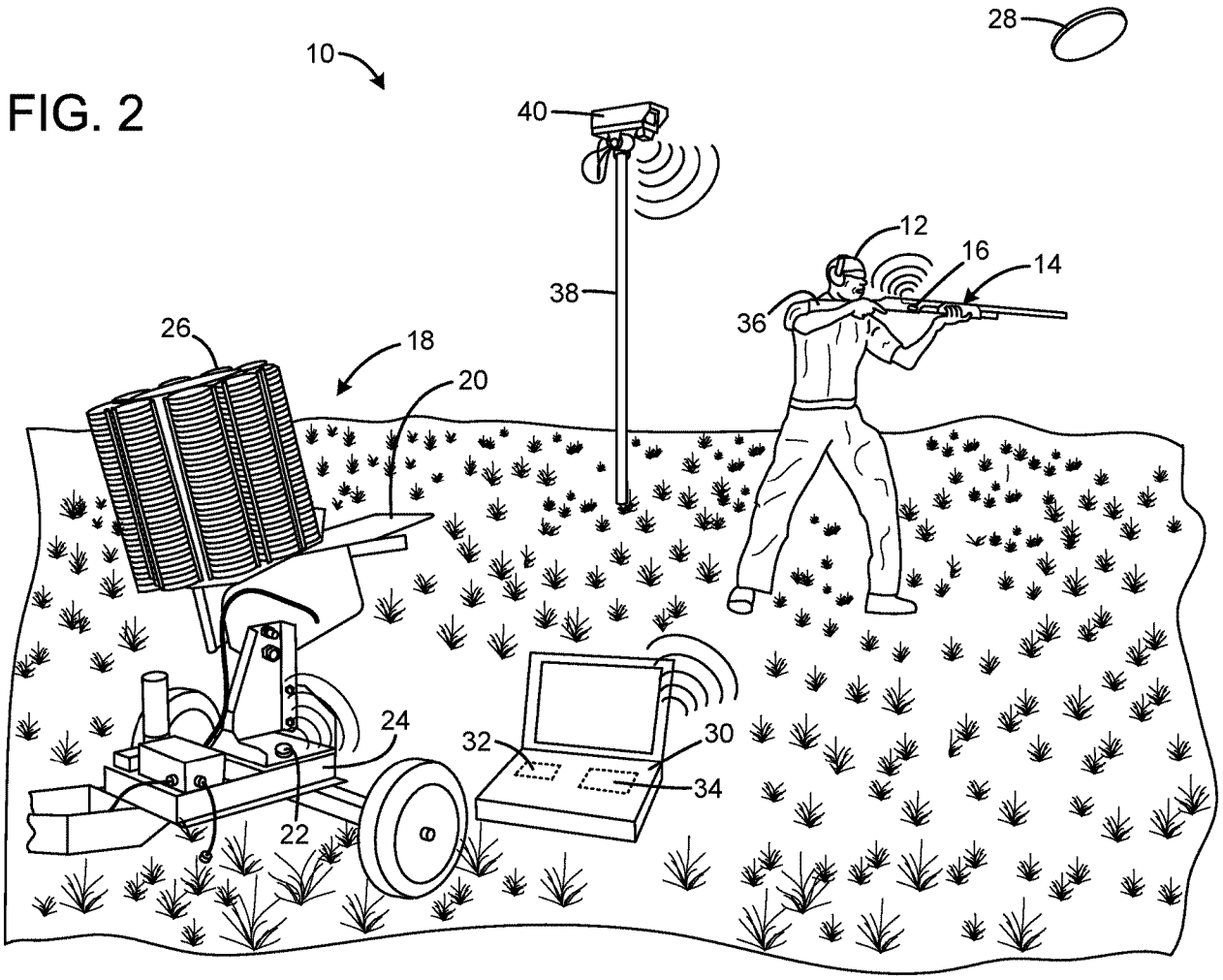
FIG. 2 is a right side perspective view of the current embodiment of the system for analyzing performance of an activity involving using an implement to strike a moving target object effectively constructed in accordance with the principles of the present invention.

FIG. 2 illustrates the improved system for analyzing performance of an activity involving using an implement to strike a moving target object effectively 10 of the present invention. More particularly, the system for analyzing performance of an activity involving using an implement to strike a moving target object effectively includes a motion sensor 16 installed on the stock 36 of a shotgun 14 and a motion sensor 22 installed on the base 24 of a trap 18. The flying clay pigeon 28 does not have an attached sensor. The motion sensor 16 collects data resulting from movement of the shotgun by the shooter 12. The motion sensor 22 collects data resulting from movement of the throwing arm 20. A portable computer 30 having a processor 32 and memory 34 is in wireless communication with the motion sensors 16, 22. The computer processes and stores the data communicated by the motion sensors 16, 22.

In use, a target clay pigeon 26 is mechanically loaded onto the throwing arm 20 of the trap 18. When the trap is triggered electronically, the throwing arm throws the target clay pigeon into the air or onto the ground. Data concerning the movement of the throwing arm, the location of the trap using the Global Positioning System (GPS), and the initial flight path of the target clay pigeon is collected by the motion sensor 22 and communicated to the computer 30. The shooter 12 moves the shotgun 14 in the conventional manner described previously to pick up, aim, and shoot at the target clay pigeon. Data concerning the movement of the shotgun, the point at which the trigger is pulled, and the point at which the shell is discharged is collected by the motion sensor 16 and communicated to the computer. An additional optional wearable sensor worn by the shooter would also enable motion to be tracked as well as biological data concerning the various phases of the shooting activity to be collected to help train both novice and expert shooters.

Using data concerning the standard characteristics of the target clay pigeon such as its weight, dimensions, and drag coefficient, data concerning standard characteristics of the shot pellets, the movement data collected by the motion sensors, location data collected by use of GPS, data regarding the trap's level or pitch to standard, and weather data such as temperature, humidity, and wind speed, the processor of the computer can calculate and display data relevant to the shooting activity. The computer can use conventional mathematical techniques for its calculations, such as those disclosed in U.S. Pat. No. 8,989,441 to Han et al. and U.S. Pat. No. 8,781,610 to Han, which are hereby incorporated by reference in their entirety The data can include the speed, angle and flight of the target clay pigeon, the origin, speed and path of the shotgun throughout each attempt and in relation to the flight of the target, the point at which the trigger is pulled, the path of the shot once it leaves the shotgun, and the result (hit or miss) and the quality of a hit.

The technology necessary to capture the motion data centers on microelectromechanical system motion sensing devices embedded in the shotgun (or on a watch or another wearable device worn by the shooter) and on the trap, combined with sophisticated, accurate motion algorithms and software that will analyze and communicate the data to computers, smart phones, tablets and other devices. One suitable motion sensor is the MPU-925X™ family of 9-axis MotionTracking™ devices manufactured by InvenSense® of San Jose, Calif. that integrates a 3-axis gyroscope, a 3-axis accelerometer and 3-axis compass with a Digital Motion Processor™ that processes the MotionFusion™ algorithms.

The technological challenges include those unique to clay pigeon shooting, such as the forces at work in the operation of the trap and the forces related to the firing of the shotgun. In connection with the shotgun, the placement of embedded motion sensing chips has been evaluated at length. As a result of this research, the best locations are on or in the butt of the grip, the forestock, the side of the stock opposite the shooter's face, or on or near the barrel. This would apply to modification of shotguns that have already been manufactured. The placement of embedded motion sensing devices in shotguns that would be produced in the future to incorporate this technology provides further design options.

Additional data regarding the actual flight of the target can be collected by an optional sensor/camera 40 that can visually observe the actual flight and communicate wirelessly with the computer 30. The most logical place to place such a sensor/camera is at the top vertical post 38 in the shooting "station" where a 360° view of the movement could be achieved. While a very expensive high speed camera would be required to capture excellent photographs of the clay, a much less expensive device could be used to capture the basic data elements of actual flight of the target.

Similar concepts will be important in the other applications of the invention, such as baseball, tennis, and football. Instead of the shotgun and trap described, the system can have motion sensors mounted on a tennis racket and on or near a tennis ball launcher or an opposing tennis player, or on a baseball bat and either on or near a pitcher or a pitching machine, or on a football player and either on or near a quarterback or a football throwing machine. Furthermore, the optional sensor/camera needs to capture data regarding the incoming ball in relation to the implement in motion that will strike it or complete the activity being measured, such as a catch of a football. In tennis, the sensor can be mounted adjacent to the net and/or behind each player. In baseball, the sensor/camera would be mounted in a predetermined place such as behind home plate or in the centerfield wall. In football, the sensor/camera would be mounted in a predetermined place such as on a goal post or sideline marker.

The various types of data collected by the current invention enable both the implement and the moving target to be tracked separately. Subsequent analysis of the collected data results in development of a third interactive data set for evaluation of the quality of the effort put forth by the user as well as comparison to known successful and/or expert attempts at the activity. Evaluation of the quality of effort is not only of value throughout the time of the activity of shooting each clay, but also during repetitive shooting of the same set of clays during a practice session or in competition.

Data collected by the invention could also be applied to "virtual" clay shooting in an indoor simulator, which captures a drone mapping of a shooting facility with traps identified with GPS precision and the launch data for each trap programmed into the system. Such a simulation can provide for more training and can also be used for entertainment purposes by an individual shooter at an individual location, and also through electronic, internet-based competition. There are also training opportunities for law enforcement and military personnel. Data collected by the invention can also be paired with a virtual reality device for a more immersive experience, and/or use of hologram technology to provide a greater depth of field experience.

While a current embodiment of system for analyzing performance of an activity involving using an implement to strike a moving target object effectively has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, in addition to the clay pigeon shooting described, the system can be used together and characterize data associated with hunting and military target practice. Furthermore, instead of the device mounted inertial motion sensors described, the system could also use other types of sensors including a radar tracker operable to track the target. In addition, the invention can include a sensor attached to the object to be tracked, especially if the sensor is inexpensive and does not affect the performance of the target. For example, a small, flexible sensor or a sensor applied as a coating containing imbedded sensing molecules and processors made of a suitable material can be part of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A system for analyzing performance of an activity involving using a movable and user-aimable implement operable to project a payload to strike a moving target object launched by a launcher effectively, the system comprising:
- a first sensor attached to the implement;
- a second sensor;
- wherein the first sensor generates a signal associated with motion of the implement;
- wherein a second sensor generates a signal associated with motion of at least one of the group consisting of the launcher and the moving target being launched;
- a processor operably coupled to the first and second sensors to receive the signals generated by the first and second sensors;
- wherein the processor analyzes the received signals to measure performance of the activity; and
- wherein the performance measured by the processor is selected from the group consisting of the speed, angle and flight of the launched target, and the origin, speed and path of the implement and the path's relation to the flight of the target.

2. The system of claim 1 wherein the implement is a firearm.

3. The system of claim 2 wherein the implement is a shotgun.

4. The system of claim 2 wherein the first sensor is attached to a location selected from the group consisting of a butt of a grip of the firearm, a forestock of the firearm, a side of a firearm stock opposite a shooter's face, and a barrel of the firearm.

5. The system of claim 1 wherein the launcher is a clay pigeon trap.

6. The system of claim 5 wherein the second sensor is attached to a portion of the clay pigeon trap.

7. The system of claim 1 wherein the activity is clay pigeon shooting.

8. A system for analyzing performance of an activity involving using a movable and user-controllable implement operable to strike a moving target object launched by a launcher effectively, the system comprising:
- a first sensor attached to the implement;
- a second sensor;
- wherein the first sensor generates a signal associated with motion of the implement;
- wherein a second sensor generates a signal associated with motion of at least one of the group consisting of the launcher and the moving target being launched;
- a processor operably coupled to the first and second sensors to receive the signals generated by the first and second sensors; and
- wherein the processor analyzes the received signals to measure performance of the activity.

9. The system of claim 8 wherein the implement is a firearm.

10. The system of claim 9 wherein the implement is a shotgun.

11. The system of claim 9 wherein the first sensor is attached to a location selected from the group consisting of a butt of a grip of the firearm, a forestock of the firearm, a side of a firearm stock opposite a shooter's face, and a barrel of the firearm.

12. The system of claim 8 wherein the launcher is a clay pigeon trap.

13. The system of claim 12 wherein the second sensor is attached to a portion of the clay pigeon trap.

14. The system of claim 8 wherein the performance measured by the processor is selected from the group consisting of the speed, angle and flight of the launched target, the origin, speed and path of the implement and the path's relation to the flight of the target, and the result (hit or miss) and the quality of a hit.

15. The system of claim 8 wherein the activity is clay pigeon shooting.

16. A system for analyzing performance of an activity involving using a movable and user-aimable implement operable to generate action upon a moving target object, the system comprising:
- a first sensor attached to the implement;
- a second sensor;
- wherein the first sensor generates a signal associated with motion of the implement;
- wherein a second sensor generates a signal associated with motion of the moving target;
- a processor operably coupled to the first and second sensors to receive the signals generated by the first and second sensors;
- wherein the processor analyzes the received signals to measure performance of the activity;
- wherein the performance measured by the processor is selected from the group consisting of the speed, angle and flight of the moving target, and the origin, speed and path of the implement and the path's relation to the flight of the target; and
- wherein the implement is a shotgun.

17. The system of claim 16 wherein the activity is clay pigeon shooting.

* * * * *